US009096341B2

(12) United States Patent
Stahlecker

(10) Patent No.: US 9,096,341 B2
(45) Date of Patent: Aug. 4, 2015

(54) CUP MADE OF PAPER MATERIAL AND METHOD FOR THE FABRICATION OF A CUP

(75) Inventor: Werner Stahlecker, Goeppingen (DE)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 295 days.

(21) Appl. No.: 13/536,144

(22) Filed: Jun. 28, 2012

(65) Prior Publication Data

US 2013/0001287 A1 Jan. 3, 2013

Related U.S. Application Data

(60) Provisional application No. 61/571,683, filed on Jul. 1, 2011.

(30) Foreign Application Priority Data

Jun. 29, 2011 (DE) ..... 10 2011 078 363

(51) Int. Cl.

| | |
|---|---|
| ***B65D 3/14*** | (2006.01) |
| ***B31C 1/06*** | (2006.01) |
| ***B65D 3/06*** | (2006.01) |
| ***B65D 21/02*** | (2006.01) |
| ***B31B 1/00*** | (2006.01) |

(52) U.S. Cl.

CPC ... *B65D 3/06* (2013.01); *B31B 1/00* (2013.01); *B65D 21/0233* (2013.01); *B31B 2201/60* (2013.01); *B31B 2217/062* (2013.01); *B31B 2217/082* (2013.01); *B65D 3/14* (2013.01)

(58) Field of Classification Search

CPC ..... B65D 3/06; B65D 3/14

USPC ..... 229/403; 206/520; 220/62.12

See application file for complete search history.

(56) References Cited

U.S. PATENT DOCUMENTS

| | | | | |
|---|---|---|---|---|
| 3,049,277 | A * | 8/1962 | Shappell | 229/403 |
| 4,211,339 | A * | 7/1980 | Itoh | 229/400 |
| 7,481,356 | B2 | 1/2009 | Stahlecker | |
| D613,554 | S * | 4/2010 | Koennecke | D7/509 |
| 7,905,821 | B2 | 3/2011 | Stahlecker | |
| 2006/0118608 | A1 | 6/2006 | Stahlecker | |
| 2009/0159653 | A1 | 6/2009 | Stahlecker | |

FOREIGN PATENT DOCUMENTS

| | | | |
|---|---|---|---|
| DE | 10 2004 056 932 | A1 | 5/2006 |
| EP | 1 785 265 | A1 | 5/2007 |

OTHER PUBLICATIONS

Search Report of European Patent Office issued in European Application No. EP 12 17 1943 dated Sep. 24, 2012 with English translation of Category of Cited Documents (5 pages).

* cited by examiner

*Primary Examiner* — Christopher Demeree

(74) *Attorney, Agent, or Firm* — Flynn, Theil, Boutell & Tanis, P.C.

(57) ABSTRACT

A cup made of paper material and having a fillable interior including a tubular wall that is at least partially conical, and a bottom wall that is joined to the tubular wall at the bottom end of its interior in a substantially liquid-tight manner. The tubular wall is produced from a plane blank, the end regions of which are joined together in an overlap region. The tubular wall delimits the interior and includes at least one deforming entity extending in the peripheral direction, wherein the peripheral deforming entity is not formed in the overlap region.

15 Claims, 4 Drawing Sheets

10
16
12

40
38
40
34

22
18
12
16
38
30
34
28

40
38
40
34
36

22
36
12
24
16
32
30
34
28

22
12
16

22
24
26
16
20
12

A-A

CUP MADE OF PAPER MATERIAL AND METHOD FOR THE FABRICATION OF A CUP

CROSS-REFERENCE TO RELATED APPLICATIONS

This application claims the benefit of German Application No. 10 2011 078 363.6, filed Jun. 29, 2011, and U.S. Provisional Application No. 61/571 683, filed Jul. 1, 2011, which are hereby incorporated by reference in their entireties.

FIELD OF THE INVENTION

The invention relates to a cup made of paper material and having a fillable interior comprising a tubular wall that is at least partially conical, and a bottom wall that is joined to the tubular wall at the bottom end of its interior in a substantially liquid-tight manner, wherein the tubular wall is produced from a plane blank, the end regions of which are joined together in an overlap region, and the tubular wall delimiting the interior comprises at least one deforming entity extending in the peripheral direction.

BACKGROUND OF THE INVENTION

German Laid-open Specification DE 10 2004 056 932 A1 discloses a cup made of paper material having a partially conical tubular wall and a bottom wall joined thereto in a substantially liquid-tight manner. The cup comprises, above its bottom wall, a peripheral deforming entity that is in the form of a so-called "stacking shoulder" and that is provided for the purpose of supporting a lower bead of an outer sleeve of the cup above it in a stack containing a plurality of cups. The peripheral deforming entity extends around the periphery of the tubular wall of the inner cup and is formed by pushing an annular plunger around the tubular wall, while the internal surface of the inner cup is abutted by a mandrel. The peripheral deforming entity is incorporated in the inner cup when the latter is in its finished state, that is, a state in which a pot-type bottom wall has already been joined to the conical tubular wall of the inner cup in a liquid-tight manner to form a peripheral edge frame, and a mouth bead has been formed at the top edge of the tubular wall of the inner cup.

European Laid-open Specification EP 1 785 265 A1 discloses a cup of a substantially identical design. When the peripheral stacking shoulder is formed by means of an annular plunger, a mandrel is placed in the interior of the inner cup such that a portion of the mandrel of reduced external periphery is disposed so as to be adjacent to the overlap region. The mandrel disposed inside the inner cup thus has a recess in the overlap region for the purpose of accommodating the double material thickness occurring in the overlap region when the stacking shoulder is formed. This recess enables the stacking shoulder to be shaped uniformly on the external periphery of the inner cup without crushing the material in this region. The peripheral stacking shoulder is incorporated in the inner cup when the latter is in its substantially finished state, that is to say, when it already has a pot-shaped bottom wall joined in a liquid-tight manner to the tubular wall to form a peripheral edge frame, and also has a mouth bead formed at the top edge of the tubular wall.

The overlap region is a critical factor in the case of a more pronounced peripheral stacking shoulder or when use is made of cheap materials or of materials that are less suitable for deformation, and leaks can occur in this overlap region. The method of forming the peripheral stacking shoulder can also result in unwanted material displacements resulting in deformation of the bottom wall of the cup so that the cup no longer stands level.

It is an object of the present invention to provide an improved cup made of paper material and an improved method for the fabrication of such a cup.

According to the invention, a cup made of paper material is provided for this purpose, which cup has a fillable interior comprising a tubular wall that is at least partially conical, and a bottom wall that is joined to the tubular wall at the bottom end of its interior in a substantially liquid-tight manner, wherein the tubular wall is produced from a plane blank, the end regions of which are joined together in an overlap region and wherein the tubular wall delimiting the interior comprises at least one deforming entity extending in the peripheral direction, which peripheral deforming entity is not formed in the overlap region.

By omitting the peripheral deforming entity or the stacking shoulder in the region of the side seam, that is, the region of the overlap, an improved cup made of paper material can be achieved, surprisingly, due to the fact that leaks are avoided in the region of said side seam. This is because no deformation takes place in this overlap region, which thus ensures that the side seam does remain intact and the end regions of the tubular wall in the overlap region do not separate from each other. Very satisfactory stacking properties of the cup of the invention can be achieved in spite of the fact that the peripheral deforming entity is omitted in the overlap region.

In a development of the invention, the peripheral deforming entity extends around the entire periphery of the tubular wall with the exception of the overlap region.

In this way, the peripheral deforming entity can serve as a means for supporting another cup, and very satisfactory stacking properties can be achieved, since the peripheral deforming entity is provided around the entire periphery of the tubular wall with the exception of the overlap region.

In a development of the invention, the peripheral deforming entity follows a curve or bend in the region adjacent to the overlap region, and the peripheral deforming entity, as regarded in the direction toward the overlap region, follows a curve or bend toward the bottom wall of the cup on both sides of the overlap region.

By means of such a bent or curved shape of the peripheral deforming entity on both sides of the overlap region, material stresses occurring due to the special structure of the paper material used for cups can be largely prevented or controlled such that they do not result in irregularly deformed cups. Thus the peripheral deforming entity does not terminate abruptly on reaching the overlap region, but rather it follows a bend or curve directed toward the bottom wall of the cup. The bent or curved shape of the peripheral deforming entity is conducive to the avoidance of regions of excessive deformation in which the paper material might tear.

In a development of the invention, the peripheral deforming entity, as regarded in the direction toward the overlap region, extends in the peripheral direction and then curves downwardly toward the bottom wall through an angle of 90°.

In this way, it is possible to combine satisfactory stacking properties of the peripheral deforming entity, free from deformation at the overlap region, with the prevention of excessive material deformation.

In a development of the invention, the peripheral deforming entity follows a curve forming the arc of a circle.

The peripheral deforming entity following a curve forming the arc of a circle having an angle of curvature of 90° toward the bottom wall is conducive to the prevention of material stresses.

In a development of the invention, the peripheral deforming entity diminishes in radial depth as it approaches the overlap region.

In this way, the depth of the peripheral deforming entity and thus also the necessary material deformation can be gradually diminished as it approaches the overlap. Advantageously, the depth of the peripheral deforming entity diminishes gradually down to zero. In this case, the peripheral deforming entity does not terminate abruptly so that the material near the overlap region is not exposed to excessive stresses or deformation.

In a development of the invention, the inside diameter of the tubular wall at the level of the peripheral deforming entity is smaller than the inside diameter of the tubular wall at the level of the bottom wall.

In this way, excellent stacking properties can be achieved. The peripheral deforming entity or the stacking shoulder then protrudes into the interior to an extent that even makes it possible to compensate for tolerances in the shape of the stacked cup above, that is, for example, in the peripheral edge frame thereof implemented for stacking purposes. Since the overlap region is relieved of such severe deformation, leaks in the overlap region are obviated.

The object of the invention is also achieved by a method for the fabrication of a cup made of paper material, which method includes the following steps: shaping a plane blank to form a substantially conical tubular wall and joining the end regions of the blank to each other in an overlap region, inserting a pot-shaped bottom wall into the conical tubular wall so that the peripheral pot-shaped radial wall of the pot-shaped bottom wall is substantially parallel to the internal surface of the conical tubular wall, and incorporating a peripheral deforming entity in the conical tubular wall excluding the overlap region.

By excluding the overlap region during the process of incorporating the peripheral deforming entity, it is possible to avoid the occurrence of leaks in the overlap region. Advantageously, the process of forming the peripheral deforming entity is carried out before the tubular wall is joined to the pot-shaped radial wall of the bottom wall in a secure and liquid-tight manner to form a peripheral edge frame. Advantageously, the tubular wall is merely wrapped around the bottom edge of the pot-shaped radial wall of the bottom wall without there being a firm joint between the tubular wall and the pot-shaped radial wall of the bottom wall. The process of wrapping the bottom end of the tubular wall is also referred to as the so-called process of rolling the bottom wall and it is typically carried out by moving a groove-shaped plunger toward the bottom edge of the tubular wall. Consequently, the bottom edge is rolled in through 180° and, as a result, that region of the tubular wall which protrudes beyond the bottom edge of the pot-shaped radial wall of the bottom wall is wrapped around the bottom edge of said pot-shaped radial wall. Alternatively, the tubular wall can be joined exclusively to the external surface of the pot-shaped radial wall so that it is then not necessary to wrap the bottom region of the tubular wall. Thus displacement and compression of material resulting from the process of incorporating the peripheral deforming entity with the omission of the overlap region can be compensated before the tubular wall is joined to the bottom wall in a secure and liquid-tight manner. The omission of the overlap region when forming the peripheral deforming entity or the stacking shoulder results in the occurrence of greater material displacements than occur when forming a deforming entity extending around the entire periphery of the tubular wall. This is, for example, simply due to the fact that the tubular wall decreases in length in those regions where the peripheral deforming entity is formed, but maintains its original length in regions where the peripheral deforming entity is not formed, that is, in the overlap region. Such increased material displacements can result in paper cups that are not shaped uniformly and that therefore might suffer from problems relating to their leak tightness and are especially considered by users as being lopsided and inferior. Surprisingly, it is possible, by means of the present invention, to compensate for these increased material displacements occurring when the peripheral deforming entity is formed with the omission of the overlap region by forming the peripheral deforming entity before the tubular wall has been securely joined to the bottom wall in a liquid-tight manner.

In a development of the invention, the process of wrapping the bottom region of the conical tubular wall around the pot-shaped radial wall and the method of forming the peripheral deforming entity are carried out essentially simultaneously.

For example, the process of wrapping the bottom region of the conical tubular wall or the process of rolling the bottom wall can be carried out by moving a groove-shaped plunger toward the bottom end of the tubular wall. The plunger, as regarded in the direction toward the cup, comprises a peripheral ring that is then moved toward the tubular wall from the outside and that shapes the peripheral deforming entity whilst excluding the overlap region. The process of forming the peripheral deforming entity can be carried out by axially moving the ring toward the conical tubular wall, but it may also be carried out, for example, by moving a plurality of plungers in the radial direction towards the conical tubular wall. At all events, the ring or the plunger are designed such that the overlap region is excluded and no peripheral deforming entity or stacking shoulder is formed in said overlap region.

In a development of the invention, the processes of wrapping the bottom region of the conical tubular wall and of forming the peripheral deforming entity are carried out by pushing a plunger over the bottom region of the conical tubular wall in a direction that is parallel to the longitudinal center axis of the conical tubular wall.

The process of pushing the plunger axially parallel to the longitudinal center axis also enables peripheral deforming entities protruding by a comparatively large distance into the interior to be reliably formed without resulting in any damage to the paper material. In particular, the paper material of the tubular wall will not be stretched during such a procedure, but is, rather, folded down more or less inwardly, and the height of the cup between the peripheral deforming entity and the bottom edge of the cup is reduced at the same time as the peripheral deforming entity is formed. As mentioned above, this reduction in height, as regarded over the periphery of the cup, is carried out unevenly since the overlap region is excluded. The resulting material displacements within the tubular wall can thus be compensated for in that the process of rolling the bottom wall or wrapping the tubular wall is carried out at the same time as the process of forming the peripheral deforming entity, whilst the process of forming the peripheral edge frame, by means of which the tubular wall is then securely joined in a liquid-tight manner to the pot-shaped radial wall of the bottom wall is not carried out before the peripheral deforming entity has been formed.

In a development of the invention, the process of pressing the pot-shaped radial wall of the bottom wall and the conical tubular wall together in a liquid-tight manner is carried out after the step of forming the peripheral deforming entity.

The object of the invention is also achieved by a device for carrying out the method of the invention, which device comprises a mandrel and a plunger for incorporating a peripheral deforming entity in a conical tubular wall of a cup made of paper material, with the mandrel comprising a step or heel extending in the peripheral direction and the plunger comprising an annular portion for shaping the peripheral deforming entity, wherein the step or heel is discontinued in the overlap region in the tubular wall and/or the annular portion of the plunger is recessed in the overlap region of the tubular wall.

The provision of the discontinued step on the core mandrel in the overlap region reduces the risk of the paper material becoming wrinkled in this region, that is, at the level of the peripheral deforming entity to be formed and in the region of the side seam or overlap.

Additional features and advantages of the invention are revealed in the claims and in the following description of preferred embodiments of the invention, with reference to the drawings. Individual features of the different embodiments shown can be arbitrarily combined with each other, as required, without going beyond the scope of the present invention.

DETAILED DESCRIPTION

Figure 1:
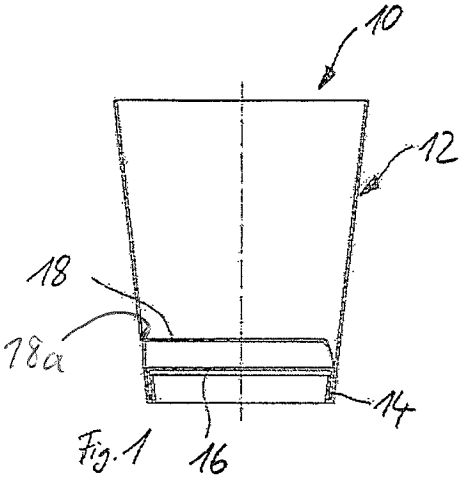
FIG. 1 is a first cross-sectional view of a cup of the invention made of paper material.

FIG. 1 shows a cup 10 of the invention made of paper material. The cup 10 shown is in a partially finished state, since the cup may additionally be provided, for example at its top edge, with a mouth bead, and, for example, an outer sleeve may be pushed over the cup 10 for insulating and stabilizing the same.

The cup 10 comprises a generally conical tubular wall 12 that is joined to a generally pot-type bottom wall 16 to form a peripheral edge frame 14. For the purpose of forming the peripheral edge frame 14, a portion of the tubular wall 12 protruding beyond the bottom wall 16, i.e. its pot-shaped radial wall, is wrapped around the pot-shaped radial wall of the bottom wall 16, and the tubular wall 12 and the bottom wall 16 are then pressed together and glued or sealed in this wrapped region. Thus the bottom wall 16 and the tubular wall 12 are securely fixed to each other in a liquid-tight manner.

The tubular wall 12 of the cup 10 is provided with a peripheral deforming entity 18 that extends in the peripheral direction of the tubular wall and that is discontinued only in the region of the cup 10 shown in the right half of FIG. 1. This region shown in the right half of FIG. 1 forms the overlap region 20 in which the end regions of a plane blank, from which the conical tubular wall 12 is produced, overlap and are sealed or glued to each other. This overlap region 20 is clearly visible in FIG. 2.

Figure 2:
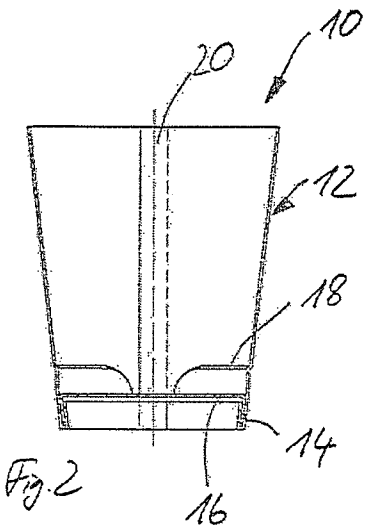
FIG. 2 is a second cross-sectional view of a cup of the invention, in which the cross-sectional plane indicated in FIG. 2 is rotated about the longitudinal center axis of the cup by 90° in relation to the cross-sectional plane shown in FIG. 1.

As may also be seen from FIG. 2, the peripheral deforming entity 18 reduces the inside diameter of the tubular wall 12 and forms a peripheral stacking shoulder 18*a* that is omitted or discontinued only in the overlap region 20. The peripheral deforming entity 18 extends in a curved manner downwardly toward the bottom wall 16 (see FIG. 2) in the region adjoining the overlap region 20. The peripheral deforming entity, as regarded in the direction toward the overlap region, initially extends in the peripheral direction and then curves downwardly, forming an arc of a circle, until said peripheral deforming entity, having curved through an angle of 90°, is approximately parallel to the overlap region 20 and terminates at the level of the bottom wall 16. The depth of the peripheral deforming entity 18, as regarded in the radial direction, diminishes along the curve through 90° until its depth is approximately zero at the level of the bottom wall 16. This curved shape of the peripheral deforming entity 18 is provided on both sides of the overlap region 20 and assists in controlling material displacements such as occur within the tubular wall 12 as a result of the provision of the peripheral deforming entity 18, so that there is no visible impairment to the geometric truncated conical shape of the tubular wall 12.

Since the peripheral deforming entity 18 extends over the entire periphery of the tubular wall 12 with the exception of the overlap region 20, it can form a reliable shoulder for stacking cups of the same type. For example, the lower bead of an outer sleeve (not shown in the figure) of an upper cup in a stack or, for example, the peripheral edge frame 14 of an upper cup in the stack can rest on the peripheral deforming entity 18 of the cup beneath it. The omission of the peripheral deforming entity 18 in the overlap region 20 does not impair the stacking properties of the cup 10 of the invention.

The peripheral deforming entity 18, as regarded in the radial direction, has a depth such that an inside diameter of the cup at the level of the peripheral deforming entity 18 is smaller than the inside diameter of the cup at the level of the bottom wall 16. Above the bottom wall 16, as regarded in the direction toward the open end of the cup 10, there follows a region having a diameter that diminishes slightly until the peripheral deforming entity 18 is reached. The provision of such a pronounced shape of the peripheral deforming entity in the sense of an abrupt constriction in the cross-section of the interior of the cup is not absolutely necessary, but may be provided if desired. Alternatively, a cylindrical region may extend up to the peripheral deforming entity 18, as regarded from the bottom wall 16 toward the top, or the region between the peripheral deforming entity 18 and the bottom wall 16 can exhibit a diameter that increases slightly toward the top.

Figure 3:
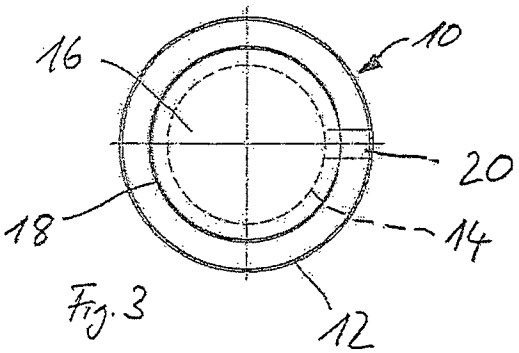
FIG. 3 is a top view of a cup of the invention.

FIG. 3 is a view of a cup 10 of the invention taken from above. The cup 10 has a maximum diameter at the top edge of the generally conical tubular wall 12. The interior of the cup 10 is closed downwardly by the bottom wall 16. The peripheral edge frame 14 is not in fact visible in the view shown in FIG. 3, and the bottom edge of the peripheral edge frame 14 is therefore merely denoted by dashed lines. As can be seen from FIG. 3, the peripheral deforming entity 18 extends around the entire periphery of the tubular wall 12 with the exception of the overlap region 20. The peripheral deforming entity 18 is not provided in the overlap region 20 so that there is no deformation of the tubular wall in this region. As may be seen from FIG. 3, the depth of the peripheral deforming entity 18, as regarded in the radial direction, diminishes gradually to zero toward the overlap region 20 so that there is no deformation in the overlap region 20.

As mentioned above, the cup 10 may be provided at the top edge of the tubular wall 12 with a mouth bead for completion thereof, and, for example, a generally truncated conical outer sleeve can be pushed over the cup 10 and fixed thereto, if desired, in order to improve the insulating properties of the same.

Figures 4, 5, 6, 7, 8, 9, 10:
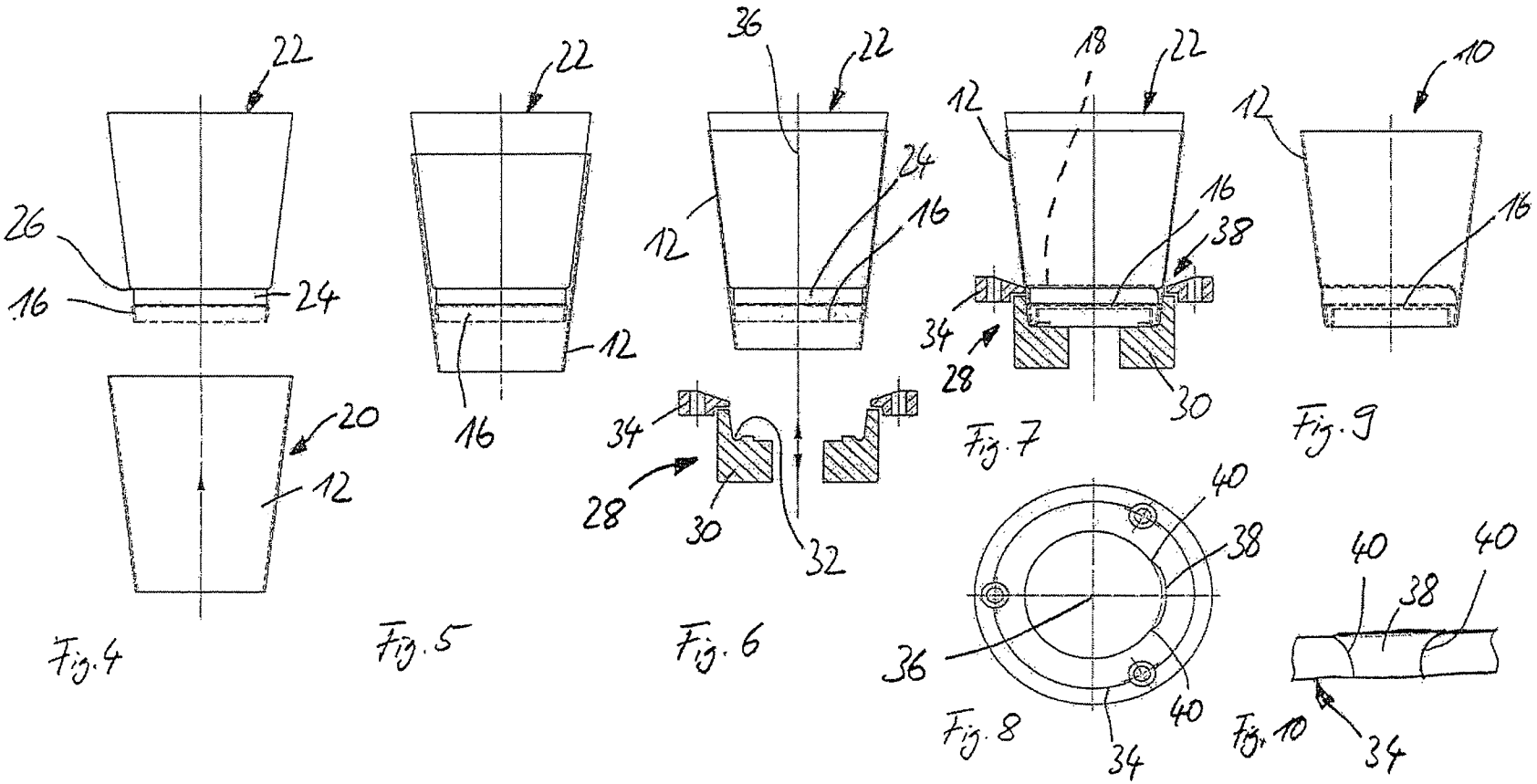
FIG. 4 illustrates a first method step involved in the fabrication of the cup of the invention.
FIG. 5 illustrates a second method step involved in the fabrication of the cup of the invention.
FIG. 6 illustrates a third method step involved in the fabrication of the cup of the invention.
FIG. 7 illustrates a fourth method step involved in the fabrication of the cup of the invention.
FIG. 8 is a top view of the plunger used in the method of the invention, as shown in FIG. 7.
FIG. 9 is a view of the cup of the invention following the method step illustrated in FIG. 7.
FIG. 10 is a partial view, taken from the inside, of a plunger similar to that shown in FIG. 8.

FIG. 4 illustrates a first method step involved in the fabrication of the cup 10 of the invention shown in FIG. 1. The tubular wall 12 already has the shape of a truncated conical component and is produced from a plane blank shaped as a circular ring segment by causing its end regions to form an overlapped joint, in which state they are fixed to each other. This overlap region 20 is not shown in FIG. 4 for the sake of clarity. The tubular wall 12 in the form of a truncated conical component is now pushed over a mandrel 22 that has a generally truncated conical shape and the same cone angle as the tubular wall 12. At its bottom end shown in FIG. 4, the mandrel 22 is provided with a plain cylindrical portion 24, at the end face of which the pot-type bottom wall 16 is disposed. The bottom wall 16 is retained on the end face of the plain cylindrical portion 24, for example, by means of negative pressure. The plain cylindrical portion 24 merges into the truncated conical portion of the mandrel 22 to form a heel 26. The heel 26 does not extend around the entire periphery of the mandrel 22 and its purpose is to form a counter support when the peripheral deforming entity 18 is being shaped.

As shown in FIG. 5, the tubular wall 12 is now pushed over the mandrel 22 until the pot-shaped radial wall of the bottom wall 16 rests against an internal surface of the tubular wall 12 in a direction parallel to the same (see FIG. 6). When this state has been achieved, a two-piece plunger 28 is moved upwardly toward the bottom end of the tubular wall 12. A first pot-type portion 30 of the two-piece plunger 28 comprises a groove-shaped recess 32 that is circular in shape and that accommodates the bottom edge of the tubular wall 12 and bends or rolls the same through 180°. As a result, the region of the tubular wall 12 that protrudes beyond the bottom edge of the pot-shaped radial wall of the bottom wall 16 is wrapped around said bottom edge. The state of this bottom region of the tubular wall 12 after this so-called method of "rolling the bottom wall" can be discerned in FIG. 7 and in FIG. 9. As can be seen from the figures, the bottom region of the tubular wall 12 is wrapped around the pot-shaped radial wall of the bottom wall 16, but it only rests against the external surface of the pot-shaped radial wall, whereas there is a space on the inside between the wrapped region of the tubular wall 12 and the pot-shaped radial wall of the bottom wall 16. In this state, as shown in FIG. 7 and in FIG. 9, the bottom wall 16 can be moved to a slight degree relatively to the tubular wall 12.

A second portion 34 of the plunger 28 is annular in shape and is adapted to form the peripheral deforming entity 18. This second, annular portion 34 is moved upwardly at the same time as the pot-shaped, first portion 30 toward the tubular wall 12 resting on the mandrel 22. However, the inside diameter of the ring 34 is larger than the outside diameter of the plain cylindrical portion 24 of the mandrel 22 by approximately the thickness of the paper material of the tubular wall 12, and thus presses those portions of the tubular wall 12 which are located radially outside the plain cylindrical region 24 of the mandrel 22 inwardly and thus forms the peripheral deforming entity 18. The process of pushing the two-piece plunger 28 over the tubular wall 12 is carried out in the axial direction parallel to the longitudinal center axis 36 of the tubular wall 12 and the bottom wall 16. FIG. 7 shows the state achieved when the two-piece plunger 28 has been completely pushed over the tubular wall 12. In this state, the bottom edge of the tubular wall 12 has been wrapped or rolled through 180° by means of the first, pot-type portion 30. The second, annular portion 34 has pressed or folded the tubular wall 12 inwardly so as to form the peripheral deforming entity 18.

As can be seen from FIG. 8, the inside diameter of the second, annular portion 34 comprises a flared portion 38 that rests against the tubular wall 12 in the radial direction, except in the overlap region, when the second, annular portion 34 of the plunger 28 is pushed over the tubular wall. This radially outwardly flared portion 38 on the second, annular portion 34 of the plunger 28 ensures that no kind of deformation will take place in the overlap region 20. This can be seen from the right half of FIG. 7 where, in the region of the flared portion 38, there is still a gap between the external surface of the tubular wall 12 in the overlap region 20 and the internal periphery of the ring 34 so that the conical shape of the tubular wall 12 is retained in the overlap region 20 and no deformation will take place in this region.

FIG. 10 is a diagrammatical view of a possible design of the flared portion 38, as regarded from the longitudinal center axis 36. The flared portion 38 of the annular portion 34 shown in FIG. 8 comprises straight lateral edges extending substantially at right angles to the peripheral direction. It can be seen from the alternative design shown in FIG. 10 that the lateral edges 40 of the flared portion 38 do not form a straight line but instead follow approximately the curve of an arc of a circle, the width of the flared portion diminishing downwardly from the top. Thus, when the second, annular portion 34 of the plunger 28 is pushed over the tubular wall 12, the peripheral deforming entity 18 assumes a shape that is curved in the form of an arc of a circle downwardly toward the bottom wall 16, on each side of the overlap region 20. In the embodiment shown, the lateral edges 40 are at an angle of curvature of 90° so that they are approximately parallel to the boundary lines of the overlap region 20 at the bottom end of the second portion 34 of the plunger 28.

FIG. 9 now shows the cup 10 in the state achieved when the two-piece plunger 28 has been removed from the bottom portion of the tubular wall 12 in a direction parallel to the longitudinal center axis 36 and the mandrel 22 has also been removed. The cup 10 is partially finished in this state. In order to make the cup 10 liquid-tight, it is still necessary to form the peripheral edge frame by pressing the wrapped portion of the tubular wall 12 from the inside against the pot-shaped radial wall of the bottom wall 16 and the three parallel layers of the tubular wall 12 and the bottom wall 16 are then pressed, glued and/or sealed together. The cup may then be completed by providing the top edge of the tubular wall 12 with a mouth bead and, for example, by pushing an insulating outer sleeve over the cup 12.

Figure 11:
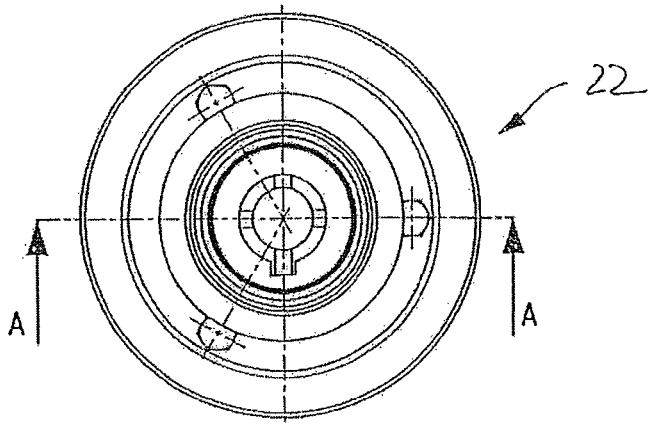
FIG. 11 is a top view of a core mandrel used in the method of the invention, as shown in FIG. 4.
Figure 12:
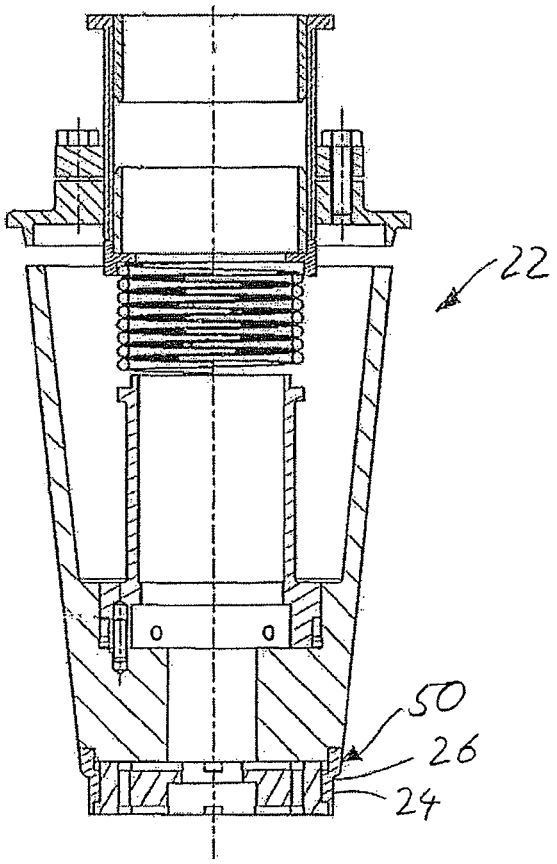
FIG. 12 is a view of the cross-sectional plane A-A indicated in FIG. 11.

FIG. 11 is a top view of the mandrel 22 shown diagrammatically in FIGS. 4 to 7. FIG. 12 is a view of the cross-sectional plane A-A indicated in FIG. 11.

The plain cylindrical portion 24 of the mandrel 22 and the heel 26 are provided on a ring 50 that forms the bottom end of the mandrel 22. The heel 26 does not extend around the entire periphery of the ring 50, as it is not formed in that portion of the periphery that is adjacent to the overlap region 20 on the tubular wall 12.

Figure 15:
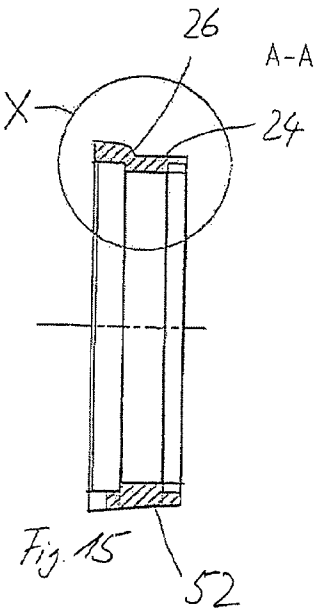
FIG. 15 is a view of the cross-sectional plane A-A indicated in FIG. 13.
Figure 13:
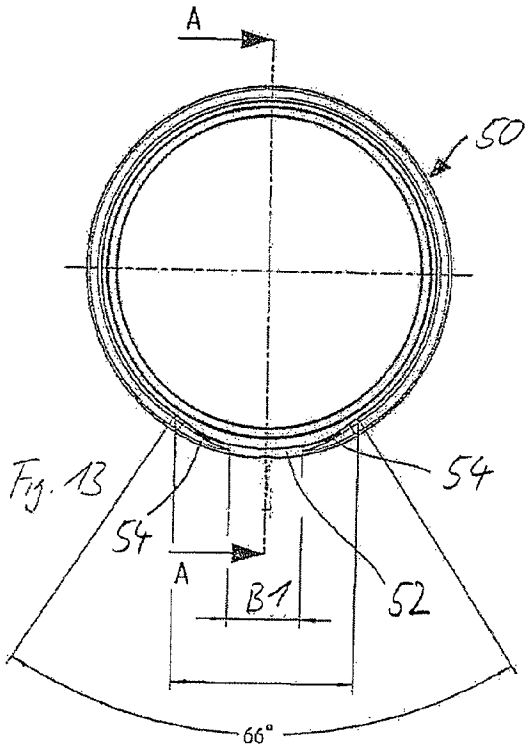
FIG. 13 is a top view of a ring on the core mandrel shown in FIG. 12.
Figure 16:
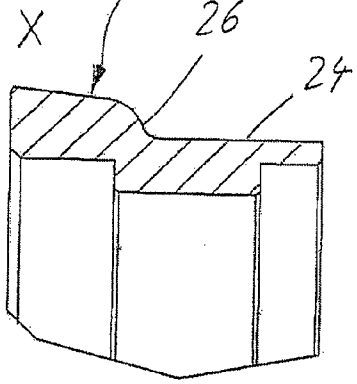
FIG. 16 shows the detail X in FIG. 15 on a larger scale.
Figure 14:
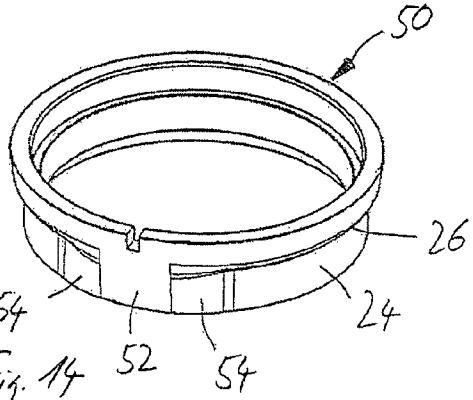
FIG. 14 is a view, taken obliquely from above, of the ring shown in FIG. 13.

FIG. 13 is a top view of the ring 50. The heel 26 is not formed in a region 52, and the ring 50 therefore has in this region a circumferential surface that corresponds to a portion of a circumferential surface of a truncated cone. The region 52 is clearly visible in the view of the cross-sectional plane A-A indicated in FIG. 15. The plain cylindrical portion 24 is also discontinued in the region 52. Each side of the region 52 is adjoined by a transition region 54, in which the heel 26 is formed but with a depth that increases in the direction extending away from the region 52. Therefore, the depth of the heel 26 increases in both peripheral directions starting from the region 52 until the heel 26 has achieved its intended depth at the end of the transition region 54, and the heel 26 then maintains this intended depth along the rest of the periphery until it reaches the transition region 54 again. The shape of the region 52 and the transition regions 54 on the ring 50 can also be discerned in FIG. 14. The plain cylindrical region 24 also terminates at the start of the two transition regions 54, and the transition regions 54 form a gradually extending transition to the region 52. The provision of the region 52 on the mandrel 22 can ensure that the peripheral deforming entity 18 is not formed in the overlap region 20 and the shape of the cup shown in FIG. 2 is achieved as a result.

As may be seen from FIG. 13, the width B1 of the region 52 is approximately as large as that of each of the transition regions 54. This can ensure a smooth and gradual transition from the heel 26 and the plain cylindrical region 24 to the region 52. This smooth, gradual transition in turn ensures that the paper material of the tubular wall 12 is not exposed to excessive stresses or that it does not tear in the process of deforming the paper material of the tubular wall 12 while the peripheral deforming entity 18 is being formed. As mentioned above, the region 52 is located opposite to the flared portion 38 in the annular portion 34 of the plunger 28 in the method step illustrated in FIGS. 6 and 7; that is to say, when the peripheral deforming entity 18 is being formed.

The invention claimed is:

1. A cup made of paper material and having a fillable interior, which is formed by means of an at least partially conical tubular wall and a bottom wall, wherein said bottom wall is joined to said tubular wall in the region of a bottom end of said interior in a substantially liquid-tight manner, wherein said tubular wall is formed from a plane blank of paper material, whose end regions are bonded to each other in an overlap region, and wherein said tubular wall delimiting said interior comprises at least one deforming entity extending in the peripheral direction and forming part of a finished said cup, said peripheral deforming entity being formed in one piece with the tubular wall from the same paper material as the tubular wall, and said peripheral deforming entity is not formed in said overlap region.

2. The cup as defined in claim 1, wherein said peripheral deforming entity extends along the entire periphery of said tubular wall with the exception of said overlap region.

3. The cup as defined in claim 1, wherein said peripheral deforming entity forms a bend or curve in the vicinity of said overlap region, wherein said peripheral deforming entity, as seen in the direction toward said overlap region, extends on both sides of said overlap region forming a bend or curve directed toward said bottom wall of said cup.

4. The cup as defined in claim 3, wherein said peripheral deforming entity deviates, in the vicinity of said overlap region, from a straight course in the peripheral direction to a bend through an angle of 90 degrees directed toward said bottom wall.

5. The cup as defined in claim 3, wherein said peripheral deforming entity bends to form an arc of a circle.

6. The cup as defined in claim 1, wherein the radial depth of said peripheral deforming entity diminishes in the direction toward said overlap region.

7. The cup as defined in claim 6, wherein said depth of said peripheral deforming entity diminishes down to zero.

8. The cup as defined in claim 1, wherein the inside diameter of said tubular wall at the level of said peripheral deforming entity is smaller than the inside diameter of said tubular wall at the level of said bottom wall.

9. The cup as defined in claim 1, wherein said overlap region extends substantially longitudinally along said tubular wall in a direction transverse to top and bottom edges of said cup.

10. The cup as defined in claim 9, wherein said peripheral deforming entity comprises a deformed portion of said tubular wall, said deformed portion comprising a shoulder formed within said interior of said cup and having a cup-stacking surface formed on an interior surface of said tubular wall, said cup-stacking surface facing away from said bottom wall for supporting a cup in a vertical stack of a plurality of said cups.

11. The cup as defined in claim 9, wherein both said tubular wall and said bottom wall are constructed of paper material.

12. The cup as defined in claim 1, wherein said overlap region extends substantially longitudinally along said tubular wall in a direction transverse to top and bottom edges of said cup, both said tubular wall and said bottom wall are constructed of paper material, and said deforming entity comprises a deformed portion of said tubular wall, said deformed portion comprising a shoulder formed within said interior of said cup and having a cup-stacking surface formed on an interior surface of said tubular wall, said cup-stacking surface facing away from said bottom wall for supporting a cup in a vertical stack of a plurality of said cups.

13. A cup made of paper material having a central longitudinal axis, said cup comprising:

a tubular wall of paper material and having oppositely facing interior and exterior surfaces and having an at least partially conical configuration, said tubular wall being formed from a planar blank and having a pair of end regions which overlap one another to define an overlapping region which extends substantially in the direction of said cup axis, said end regions being bonded to one another in said overlapping region, said tubular wall being deformed inwardly so as to define a cup-stacking shoulder of paper material formed in one piece with said tubular wall, said cup-stacking shoulder being located interiorly of said cup along said interior surface of said tubular wall and forming part of a finished said cup, said cup-stacking shoulder extending peripherally about the cup axis but being discontinued at said overlapping region; and a bottom wall of paper material joined to said tubular wall, said interior of said tubular wall and said bottom wall together defining a fillable interior, said bottom wall being joined to said tubular wall in a substantially liquid-tight manner adjacent a bottom end of said interior, and said cup-stacking shoulder being disposed adjacent said bottom wall.

14. The cup as defined in claim 13, wherein said cup-stacking shoulder extends along an entire periphery of said interior surface of said tubular wall except in said overlapping region.

15. The cup as defined in claim 13, wherein said cup-stacking shoulder has a surface oriented transversely relative to the cup axis and facing away from said bottom wall for supporting a cup in a vertical stack of a plurality of said cups.

* * * * *